US007705255B2

(12) United States Patent
Yokote

(10) Patent No.: US 7,705,255 B2
(45) Date of Patent: Apr. 27, 2010

(54) ELECTRONIC DEVICE

(75) Inventor: Satoshi Yokote, Ome (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 725 days.

(21) Appl. No.: 11/602,348

(22) Filed: Nov. 21, 2006

(65) Prior Publication Data

US 2007/0200153 A1 Aug. 30, 2007

(30) Foreign Application Priority Data

Feb. 14, 2006 (JP) ..... 2006-036891

(51) Int. Cl.
*H01H 13/06* (2006.01)

(52) U.S. Cl. ..... 200/302.2

(58) Field of Classification Search ..... 200/302.1, 200/302.3, 302.2
See application file for complete search history.

(56) References Cited

U.S. PATENT DOCUMENTS 4,170,104 A * 10/1979 Yamagata ..... 368/289

FOREIGN PATENT DOCUMENTS

| | | |
|---|---|---|
| JP | 5-11245 U | 2/1993 |
| JP | 09-161593 | 6/1997 |
| JP | 10-334759 | 12/1998 |

* cited by examiner

*Primary Examiner*—Ross N Gushi
(74) *Attorney, Agent, or Firm*—Pillsbury Winthrop Shaw Pittman, LLP

(57) ABSTRACT

According to one embodiment, an electronic device includes a housing including an opening, a button disposed in the opening, a switch contained in the housing and operated by using the button, a wall extending in the housing from that part of the housing which surrounds the opening, a sealing member interposed between the button and the switch, covering the opening, and including an edge part extending along a peripheral surface of the wall, and a holder which presses the edge part of the sealing member against the peripheral surface of the wall.

14 Claims, 10 Drawing Sheets

ELECTRONIC DEVICE

CROSS-REFERENCE TO RELATED APPLICATIONS

This application is based upon and claims the benefit of priority from Japanese Patent Application No. 2006-036891, filed Feb. 14, 2006, the entire contents of which are incorporated herein by reference.

BACKGROUND

1. Field

One embodiment of the invention relates to an electronic device including a push button, for example, to an electronic device including a sealing structure around the push button.

2. Description of the Related Art

An electronic device such as a portable computer is provided with push buttons, for example, a power switch button and a click switch button. Each push button is located in an opening of a housing of the computer such that it may be pressed with, for example, a fingertip.

When a user inadvertently spills coffer or water on the push button during operating the electronic device, the liquid will possibly enter the inside of the device housing through the opening. To cope with this, Jpn. Pat. Appln. KOKAI Publication No. 10-334759 proposes the push switch having a sealing structure.

The push switch generally includes a slide, a movable contact piece, a movable contact, and a fixed contact, and a sealing member. The sealing member is disposed between a housing case with the slide provided therein, and a housing base with the movable contact piece provided therein, and seals a space in the housing base in which the movable contact and the fixed contact are provided. When the user applies force to the slide, the sealing member and the movable contact piece are successively pressed, and the movable contact moves to come into contact with the fixed contact thereby to effect the inputting.

In the case of the sealing member, such as rubber or sponge, it is used in a state that it is compressed, for example, 20 to 40% in the thickness direction. To compress the sealing member to such an extent as just stated, a force to make such a compression is needed. Particularly, where the button size is large, the sealing member used is large. Accordingly, a large force is required to fix the sealing member. Increase of the button size brings about increase of a fixing member for fixing the sealing member in various senses.

For example, in the case where the push switch is used, as the size of the switch increases, a fixing part intercoupling the housing case and the housing base increases in size.

BRIEF DESCRIPTION OF THE SEVERAL VIEWS OF THE DRAWINGS

A general architecture that implements the various feature of the invention will now be described with reference to the drawings. The drawings and the associated descriptions are provided to illustrate embodiments of the invention and not to limit the scope of the invention.

DETAILED DESCRIPTION

Various embodiments according to the invention will be described hereinafter with reference to the accompanying drawings. In general, according to one embodiment of the invention, an electronic device includes: a housing including an opening; a button disposed in the opening; a switch contained in the housing and operated by using the button; a wall extending in the housing from that part of the housing which surrounds the opening; a sealing member interposed between the button and the switch, covering the opening, and including an edge part extending along a peripheral surface of the wall; and a holder which presses the edge part of the sealing member against the peripheral surface of the wall.

Embodiments of the present invention will be described with reference to the accompanying drawings applied to a portable computer.

Figure 1:
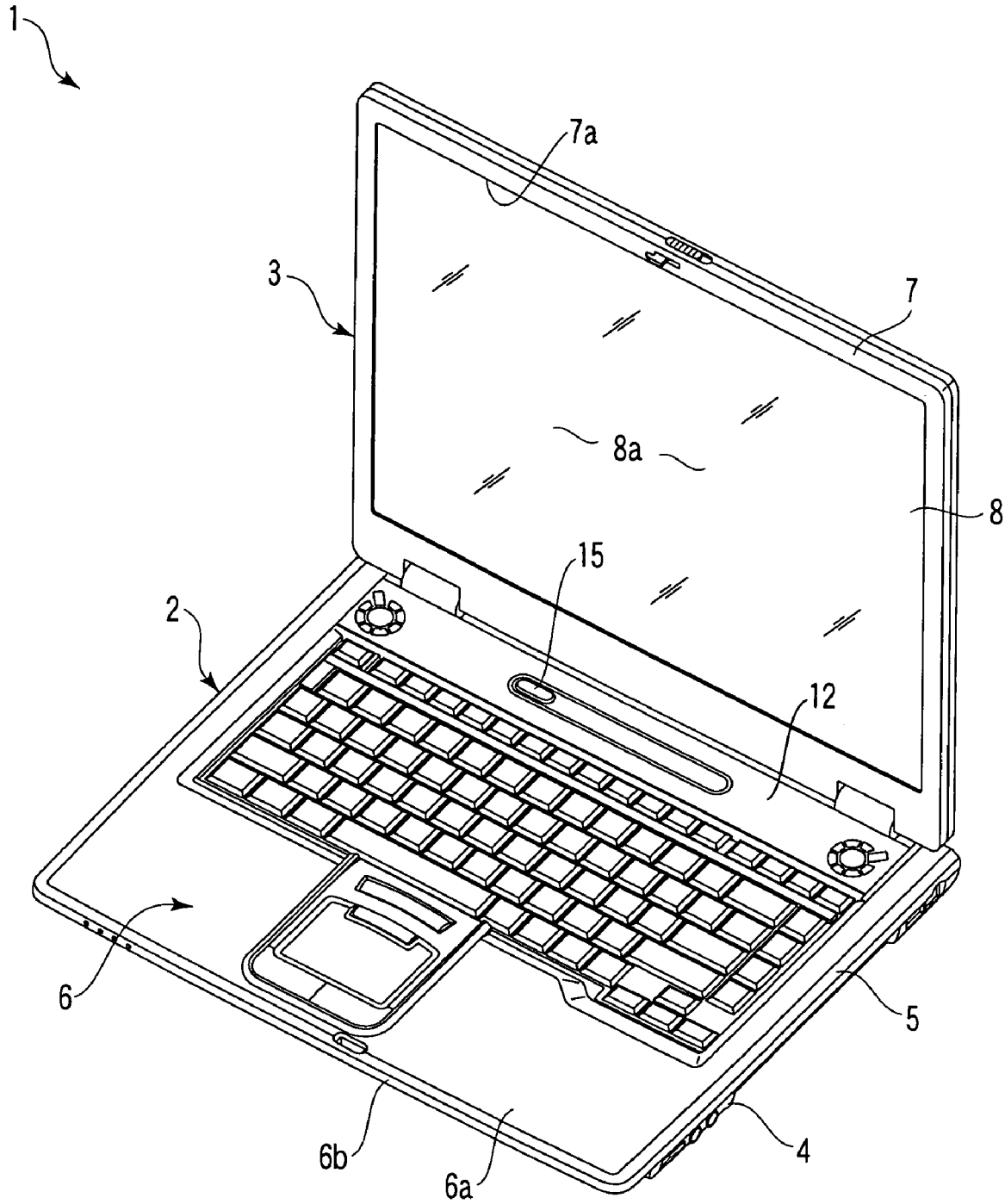
FIG. 1 is an exemplary perspective view showing a portable computer according to a first embodiment of the present invention.

FIGS. 1 to 5 show a portable computer 1 as an electronic device which is a first embodiment of the invention. As shown in FIG. 1, the portable computer 1 includes a main body 2 and a display unit 3.

The main body 2 includes a body base 4 and a body cover 5. The body cover 5 is attached to the body base 4 from above. With the attachment, the main body 2 includes a box-like housing 6 having an upper wall 6*a*, a side wall 6*b*, and a bottom wall (not shown).

The display unit 3 includes a display housing 7 and a liquid crystal display (LCD) panel 8 contained in the display housing 7. The LCD panel 8 has a display screen 8*a*. The display screen 8*a* is exposed to outside of the display housing 7 through an opening 7*a* of the display housing 7.

The display unit 3 is supported at the end part of the housing 6, with the aid of a hinge device, not shown. With the structure, the display unit 3 is turned between a close position in which the display unit 3 covers the upper wall 6*a* from above and an open position in which the display unit 3 stands up to expose the upper wall 6*a* and the display screen 8*a* to outside.

Figure 2:
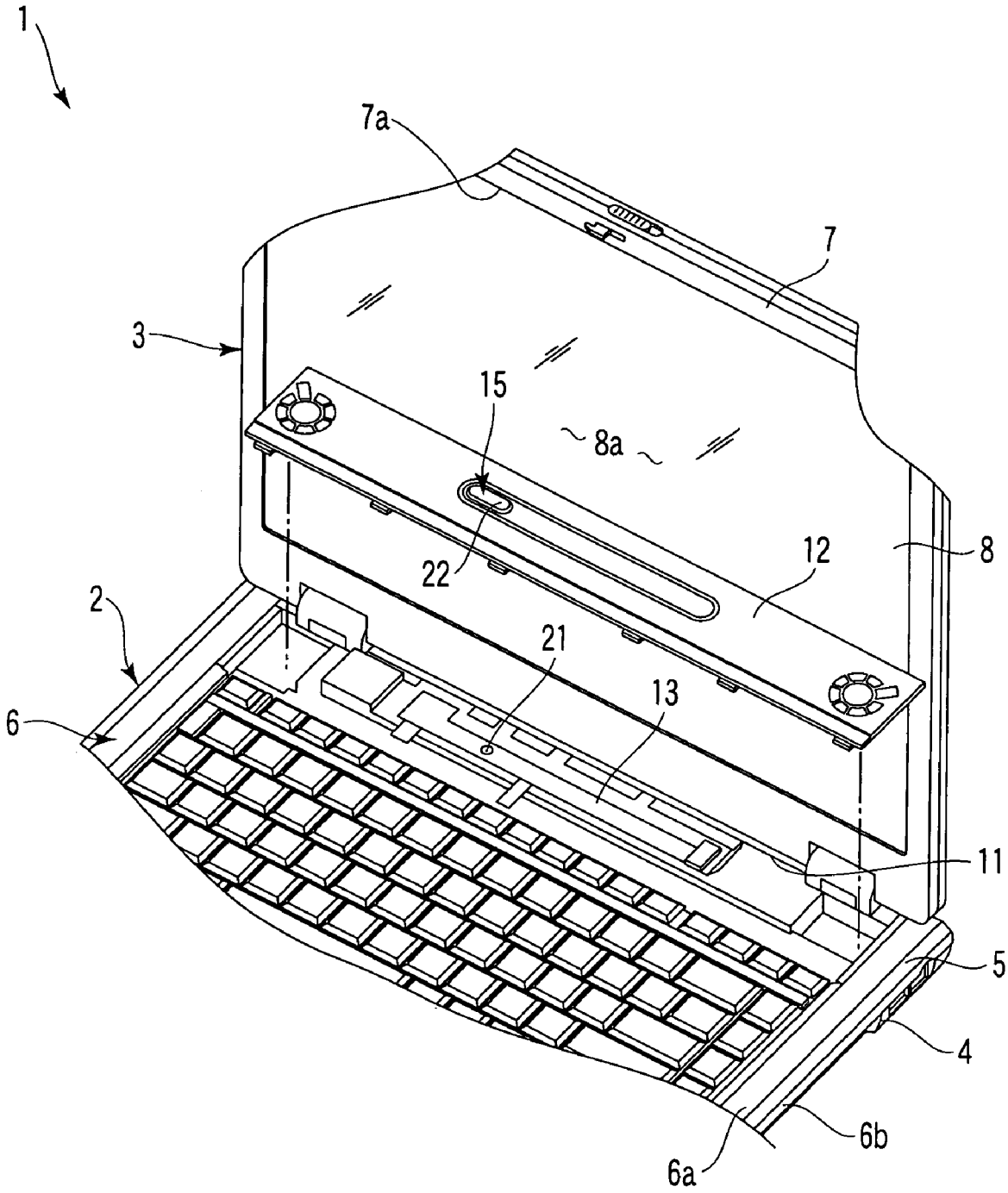
FIG. 2 is an exemplary perspective view, partially broken away, showing a part of the portable computer of the first embodiment.

As shown in FIG. 2, the housing 6 includes a first opening 11 opened to the rear part of the upper wall 6*a*, a cover 12 applied to the first opening 11. The cover 12 is detachably attached to the first opening 11 to cover the first opening 11, and forms a part of the upper wall 6*a*. The housing 6 contains a circuit board 13.

Figure 3:
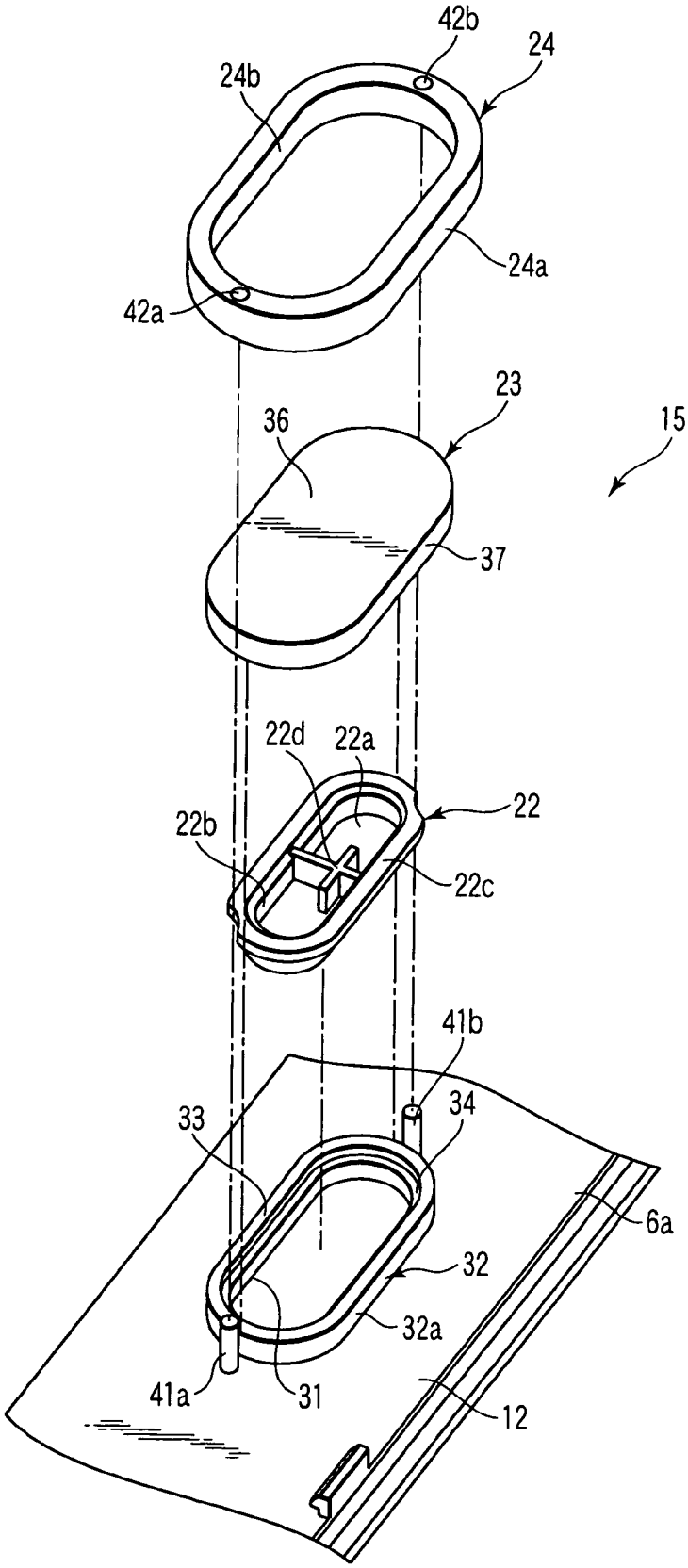
FIG. 3 is an exemplary exploded view perspectively showing a push button unit according to the first embodiment.
Figure 4:
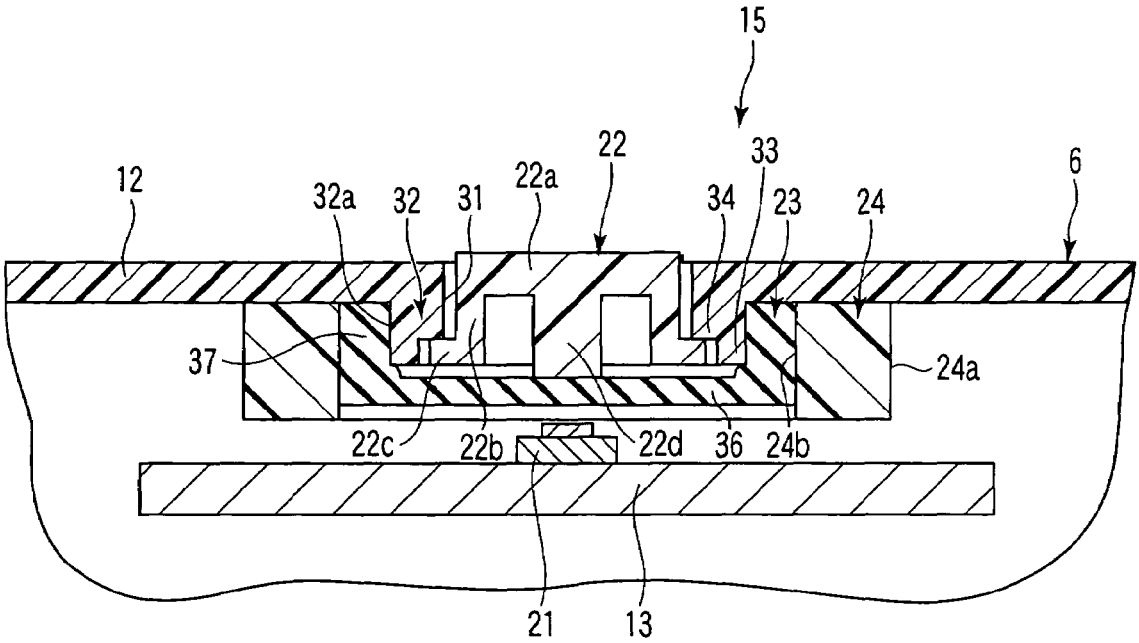
FIG. 4 is an exemplary cross-sectional view showing the button unit according to the first embodiment.

As shown in FIG. 1, the portable computer 1 is provided with a push button unit 15. As shown in FIGS. 3 and 4, the push button unit 15 includes a contact switch 21 (hereinafter abbreviated as "switch 21"), a button 22, a sealing member 23, and a holder 24. The switch 21 is mounted on the circuit board 13.

As shown in FIGS. 3 and 4, the cover 12 is opened to form a second opening 31 (hereinafter referred to as "opening 31"). The opening 31 is one size larger in outside diameter than the button 22. A standing wall 32 stands up in the housing 6 from that part of the cover 12 which surrounds the opening 31.

The standing wall 32 is formed as a frame body which is raised from the upper wall 6*a* and extends into the inside of the housing 6, and entirely surrounds the opening 31. The standing wall 32 includes an outer part 33 and an inner part 34. The outer part 33 protrudes more than the inner part 34.

The button 22 is located in the opening 31. The button 22 includes an upper wall 22*a*, a side wall 22*b*, an edge part 22*c*, and a pressing protrusion 22*d*. The upper wall 22*a* is exposed to outside of the housing 6 through the opening 31 so as to allow the user to directly press the upper wall 22*a*. The side wall 22*b* extends from the peripheral of the upper wall 22*a* downwardly in the housing 6. The edge part 22*c* extends from the extended end of the side wall 22*b* and outwardly from the button 22. The pressing protrusion 22*d* extends from the upper wall 22*a* toward the inside of the housing 6 and opposes the switch 21.

Figure 5:
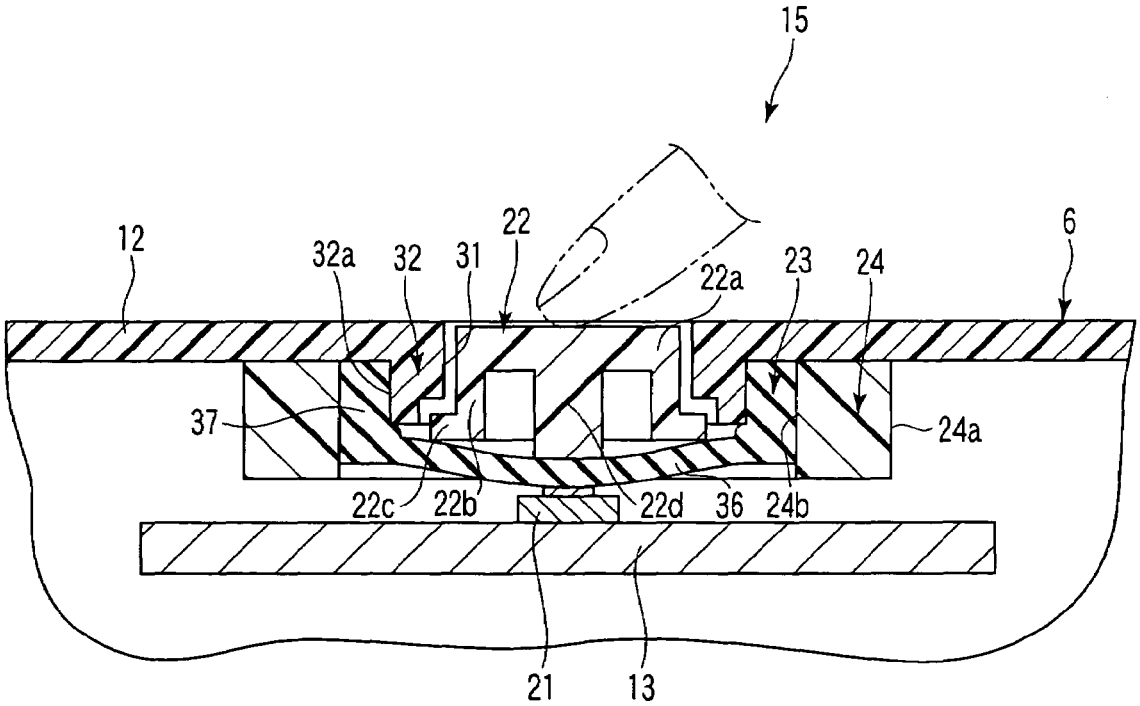
FIG. 5 is an exemplary cross-sectional view showing the button shown in FIG. 4 being pressed.

When the button 22 is set in position, the upper surface of the edge part 22*c* comes into contact with the lower surface of the inner part 34 of the standing wall 32. The result is that no ejection of the button 22 from the housing 6 is ensured. As illustrated in FIGS. 4 and 5, the button 22 opposes the switch 21 housed in the housing 6. The button 22 is movable toward and away from the switch 21 in the housing 6. The button 22 operates the switch 21 with the sealing member 23 interposed therebetween.

As shown in FIG. 4, the sealing member 23 is located between the button 22 and the switch 21. The sealing member 23 includes a flat part 36 and a raised part 37. The flat part 36, larger than the opening 31, entirely covers the lower side of the opening 31. The raised part 37 is erected on the entire edge part around the flat part 36 toward the upper wall 6*a*. The sealing member 23 is shaped like a cup having a smooth bottom. The raised part 37 is one example of the edge part of the sealing member 23.

The raised part 37 is mounted along the outer peripheral surface 32*a* of the standing wall 32, and surrounds the standing wall 32. In use, the raised part 37 is compressed by several tenths of a millimeter in thickness direction between the holder 24 and the standing wall 32. For this reason, the raised part 37 has a thickness enough to be compressed. An example of the thickness of the raised part 37 is 1 to 2 mm.

The flat part 36 is a part not compressed, and does not need such a thickness as that of the raised part 37. An example of the thickness of the flat part 36 is 0.1 mm. The thickness of the flat part 36 is not limited to specific value in particular. For example, it may be almost equal to that of the raised part 37. The sealing member 23 is made of an elastic material such as rubber or sponge.

As shown in FIG. 3, the holder 24 is larger than the standing wall 32, and takes the form of a frame body surrounding the sealing member 23. The holder 24 includes an outer peripheral surface 24*a* and an inner peripheral surface 24*b*. The inner diameter of the inner peripheral surface 24*b* is one size smaller than the outer diameter of the sealing member 23.

As shown in FIG. 4, the holder 24 is fitted to the standing wall 32 such that the raised part 37 of the sealing member 23 is put between the holder 24 and the standing wall 32. The holder 24 having been fitted to the standing wall 32 presses the raised part 37 of the sealing member 23 against the outer peripheral surface 32*a* of the standing wall 32. As a result, the raised part 37 of the sealing member 23 is held, while being compressed, between the inner peripheral surface 24*b* of the holder 24 and the outer peripheral surface 32*a* of the standing wall 32. When the raised part 37 of the sealing member 23 is compressed, the inside space of the housing 6 is liquid-tightly isolated from the opening 31.

A pair of mounting projections 41*a* and 41*b* protrude from the rear surface of the housing upper wall 6*a*. The holder 24 has a pair of mounting holes 42*a* and 42*b* corresponding in position to the mounting projections 41*a* and 41*b*. The holder 24 is positioned by inserting the mounting projections 41*a* and 41*b* respectively into the mounting holes 42*a* and 42*b*. The holder 24 is firmly fixed in the housing 6 in a manner that after the holder 24 is mounted, the tips of the mounting projections 41*a* and 41*b* are welded to the holder 24. The holder 24 may be fixed to the housing 6 by means of screws in place of welding.

Next, operations of the portable computer 1 will be described.

As shown in FIG. 5, when the user presses the button 22, the button 22 lowers into the housing 6. With the lowering of the button 22, the flat part 36 of the sealing member 23 elastically deforms and the lower surface of the flat part 36 comes into contact with the switch 21. When the flat part 36 is brought into contact with the switch 21, the switch 21 responds to the contact and an electrical signal is input to the portable computer 1. When the user removes his finger from the button 22, the button 22 automatically returns to its original position by the resiliency of the sealing member 23.

The flat part 36 of the sealing member 23 entirely covers the lower side of the opening 31. The raised part 37 of the sealing member 23 is held, while being compressed, between the holder 24 and the standing wall 32, to liquid-tightly isolate the space continuous to the opening 31 from the inside of the housing 6.

With such a structure, if the user inadvertently spills coffee or water on the housing upper wall 6*a* during operating the portable computer 1, the liquid is prevented from entering the inside of the housing 6 through the opening 31.

In the portable computer 1 thus constructed, the periphery of the opening 31 is easily sealed irrespective of the size and the configuration of the button 22. To be more specific, when the sealing member is pressed against and fixed to the lower surface of the wall formed around the opening 31, the compressing direction of the sealing member is aligned with the mounting direction of the fixing member for fixing the sealing member. Accordingly, the fixing member is mounted resisting the reaction to the compression of the sealing member. For this reason, when the button is large in size or complicated in shape, the fixing member for fixing the sealing member, such as metal sheet and screws, is increased in size and in number.

In this connection, it is noted that the sealing member 23 of the instant embodiment is held, while being compressed, between the standing wall 32 and the holder 24. Accordingly, the compressing direction of the sealing member 23 is parallel to the upper wall 6*a*. The mounting direction (i.e., fixing direction) of the holder 24 is orthogonal to the upper wall 6*a*, i.e., those directions are different.

Accordingly, in the portable computer 1, the holder 24 never receives the reaction from the sealing member 23 in the mounting direction. Therefore, large yield strength is not required for the fixing members (mounting projections 41*a* and 41*b* in the embodiment) for fixing the holder 24 in the mounting direction. This leads to size reduction.

In other words, even when sealing member 23 becomes large in size or complicated in shape depending on the size and shape of the button 22, a force required for the fixing member to fix the holder 24 is varied little from that when the sealing member has the original size and shape. Accordingly, there is no need to increase the size and number of the fixing members. Accordingly, even in the electronic device having large buttons or buttons having complicated shapes, the periphery of the opening 31 is easily and uniformly sealed by forming the standing wall 32 and the holder 24 in conformity with the shape of the opening 31.

This implies that the push button unit 15 is reduced in size, and hence, the push button unit 15 which can be placed even in a small space in the housing 6 is provided.

If the sealing member 23 extends to the outer peripheral surface 32*a* of the standing wall 32, the holder 24, which is located on the outer side of it, is not exposed to outside of the housing 6 through the opening 31. Accordingly, the portable computer 1 looks attractive.

The raised part 37 of the sealing member 23 is compressed. Conversely speaking, the flat part 36 is not compressed. Accordingly, the flat part 36 may be thinner than the raised part 37. Where the flat part 36 has a specific thickness or a thickness larger than the specific one, the key touch feeling caused when the button 22 is pressed resembles that when rubber is pushed. The user does not much like such a key touch feeling. Where the flat part 36 is formed to be thin, the rubber touch feeling decreases. This leads to operability enhancement of the portable computer 1.

Further, by providing the holder 24 separately from the housing 6, the sealing member 23 is easily put between the standing wall 32 and the holder 24.

Figure 6:
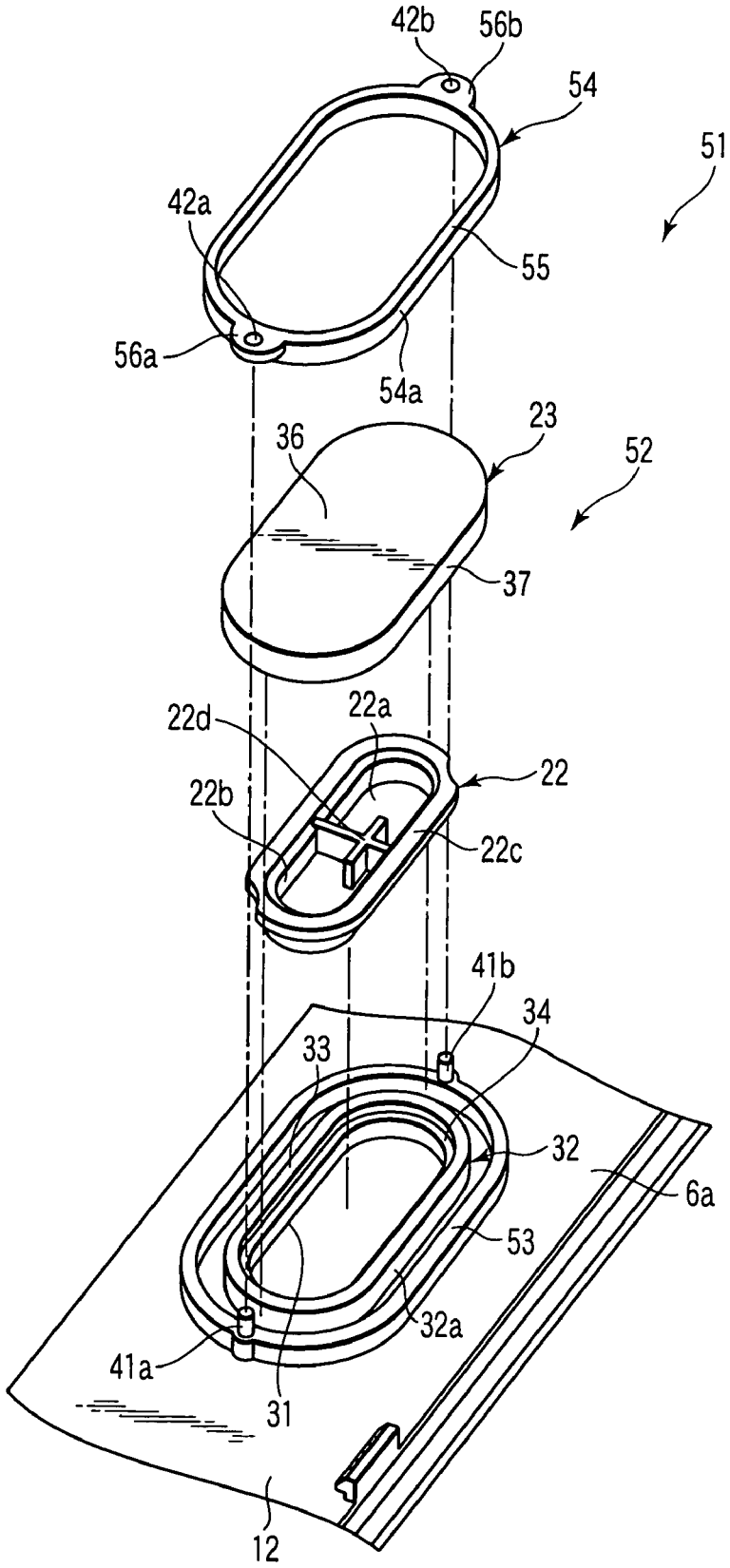
FIG. 6 is an exemplary exploded view perspectively showing a push button unit according to a second embodiment of the invention.

A portable computer 51 as an electronic device according to a second embodiment of the invention will be described with reference to FIGS. 6 and 7. Like reference numerals are used for designating like or equivalent portions in the portable computer 1 in the first embodiment, and descriptions thereof are omitted for simplicity of explanation.

The portable computer 51 includes a push button unit 52 and a second standing wall 53. The push button unit 52 includes a switch 21, a button 22, a sealing member 23, and a holder 54. As shown in FIG. 6, the second standing wall 53 is raised from an upper wall 6*a* and extends into the inside of a housing 6. The second standing wall 53 is formed as a frame body which is spaced from the standing wall 32 (referred to as "first standing wall 32" for ease of explanation), and surrounds the first standing wall 32. Mounting projections 41*a* and 41*b* protrude from the second standing wall 53.

A holder 54 is provided with a frame body 55 and a pair of mounting parts 56*a* and 56*b*. The outer diameter of the frame body 55 is substantially equal to the inner diameter of the second standing wall 53. The mounting parts 56*a* and 56*b* are located at both end parts of the frame body 55, and include mounting holes 42*a* and 42*b*, respectively.

Figure 7:
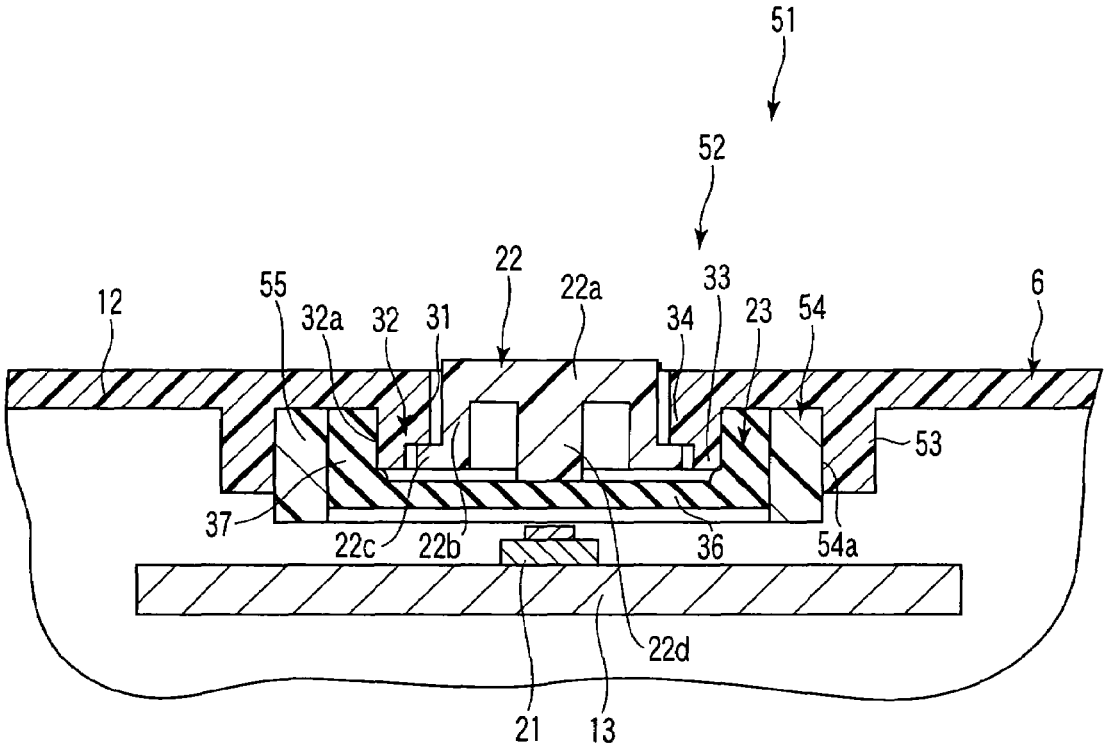
FIG. 7 is an exemplary cross-sectional view showing the push button unit according to the second embodiment.

As shown in FIG. 7, the holder 54 is fitted between the first standing wall 32 and the second standing wall 53 such that the raised part 37 of the sealing member 23 is put between the holder 54 and the first standing wall 32. The holder 54 having been fitted between the first standing wall 32 and the second standing wall 53, presses the raised part 37 of the sealing member 23 against the outer peripheral surface 32*a* of the first standing wall 32. An outer peripheral surface 54*a* of the holder 54 is supported from the outside by the second standing wall 53.

In the portable computer 51 thus constructed, the periphery of the opening 31 is easily sealed irrespective of the size and the configuration of the button 22. That is, the sealing member 23 of the instant embodiment is held, while being compressed, between the first standing wall 32 and the holder 54. As in the first embodiment, even in the electronic device having large buttons and buttons having complicated shapes, the periphery of the opening is easily and uniformly sealed without increasing the size and number of the fixing members.

The portable computer 51 of the embodiment further includes a second standing wall 53. The holder 54 receives a reaction having an outward direction from the sealing member 23. Accordingly, if the holder 54 is insufficient in strength, the holder 54 will be bent outward. If the holder 54 is bent, the sealing performance deteriorates correspondingly. When the second standing wall 53 supports the outer peripheral surface 54*a* of the holder 54, the holder 54 is not bent. With this structural feature, the sealing performance is further enhanced in the portable computer 51.

Further, if the second standing wall 53 is provided, the holder 54 is smoothly mounted by merely moving the outer peripheral surface 54*a* of the holder 54 along the second standing wall 53. This feature contributes to enhancement of the assembly workability of the portable computer 51.

Figure 9:
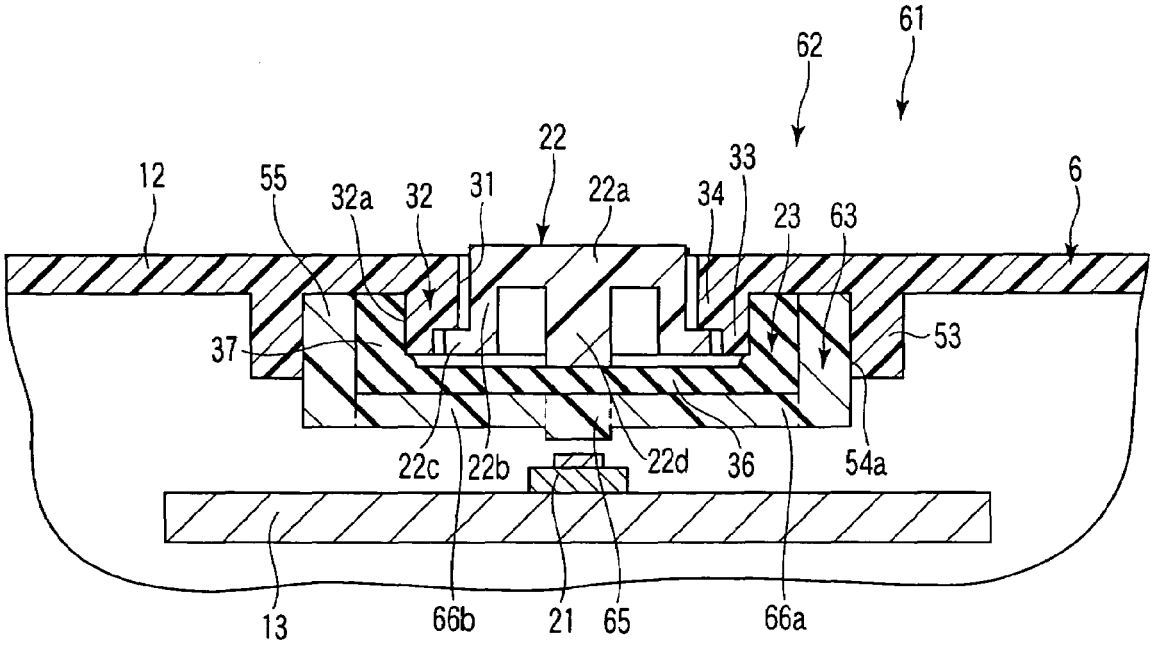
FIG. 9 is an exemplary cross-sectional view taken on line F9-F9 in FIG. 8 showing the push button unit.

A portable computer 61 as an electronic device according to a third embodiment of the invention will be described with reference to FIGS. 8 to 10. Like reference numerals are used for designating like or equivalent portions in the portable computers 1 and 51 in the first and second embodiments, and descriptions thereof are omitted for simplicity of explanation.

The portable computer 61 is provided with a push button unit 62. The push button unit 62 includes a switch 21, a button 22, a sealing member 23, and a holder 63. A cylindrical protrusion 64 is formed at the central part of the flat part 36 of the sealing member 23. The holder 63 includes a frame body 55, mounting parts 56*a* and 56*b*, a head part 65, and a pair of arms 66*a* and 66*b*. The frame body 55 is one form of the fixing part. The head part 65 is one form of the movable part.

Figure 8:
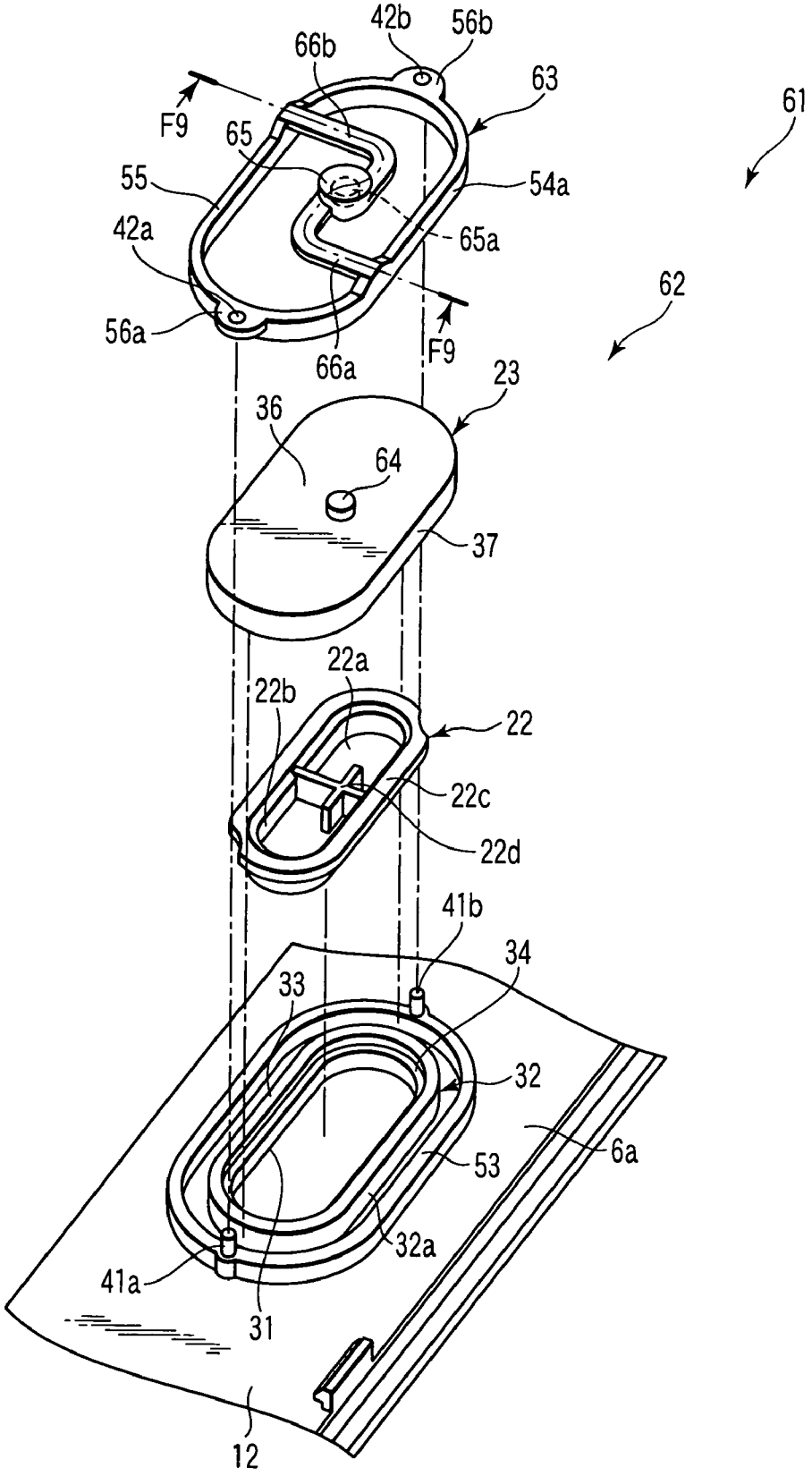
FIG. 8 is an exemplary exploded view perspectively showing a push button unit according to a third embodiment of the invention.

As shown in FIG. 8, the head part 65 is cylindrical and positioned at the central part of the holder 63. As shown in FIG. 9, the head part 65 faces the switch 21 from above the switch 21. As shown in FIG. 8, one arm 66*a* ranges from one side of the frame body 55 to the head part 65, thereby connecting the head part 65 to the frame body 55. The other arm 66*a* ranges from the other side of the frame body 55 to the head part 65, thereby connecting the head part 65 to the frame body 55. The arms 66*a* and 66*b* are made of an elastic material such as synthetic resin. The head part 65, supported by the arms 66*a* and 66*b*, is movable to and from the switch 21.

The head part 65 includes a hole 65*a* opened toward the sealing member 23. The hole 65*a* is formed at a position corresponding to that of the cylindrical protrusion 64 of the sealing member 23, and receives the cylindrical protrusion 64.

Next, operations of the portable computer 61 will be described.

Figure 10:
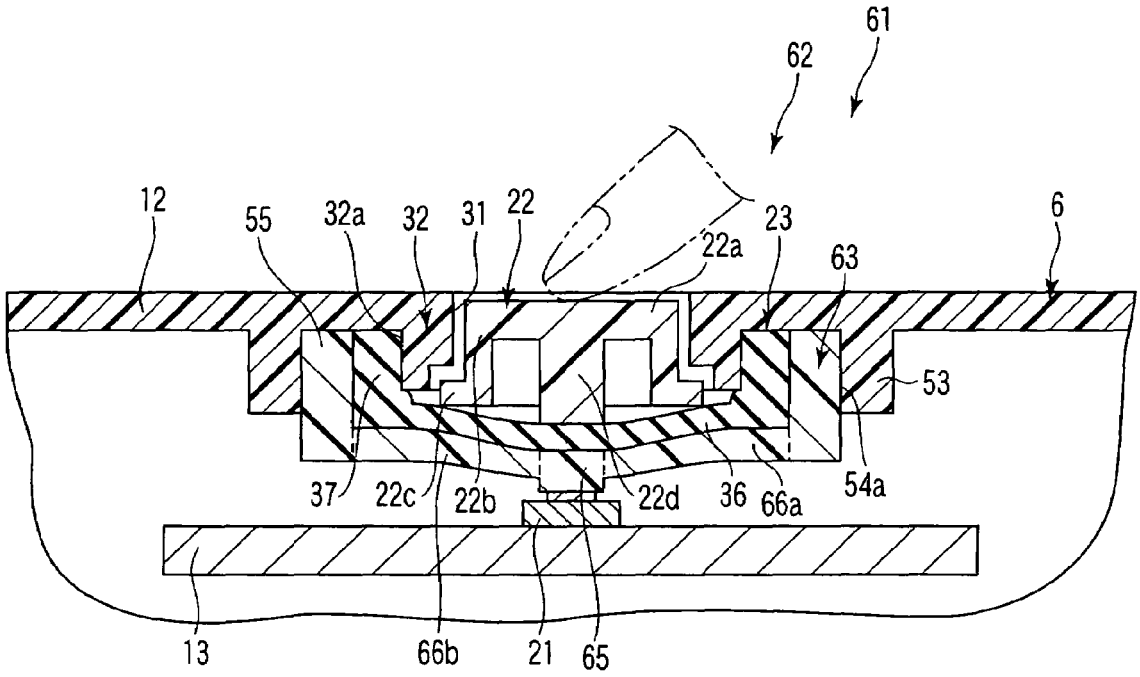
FIG. 10 is an exemplary cross-sectional view showing the button shown in FIG. 9 being pressed.

As shown in FIG. 10, when the user presses the button 22, the button 22 lowers into the housing 6. With downward movement of the button 22, the arms 66*a* and 66*b* of the holder 63 are elastically deformed via the sealing member 23 and the head part 65 comes into contact with the switch 21. When the head part 65 is brought into contact with the switch 21, the switch 21 responds to the contact and a signal is input to the portable computer 61. When the user removes his finger from the button 22, the button 22 automatically returns to its original position by the resiliency of the arms 66*a* and 66*b*.

In the portable computer 61 thus constructed, the periphery of the opening 31 is easily sealed irrespective of the size and the configuration of the button 22. That is, the sealing member 23 of the instant embodiment is held, while being compressed, between the first standing wall 32 and the holder 63. As in the second embodiment, even in the electronic device having large buttons or buttons having complicated shapes, the periphery of the opening is easily and uniformly sealed without increasing the size and number of the fixing members.

Further, the holder 63 in the instant embodiment includes the head part 65 and the arms 66*a* and 66*b*. The button 22 is elastically supported by the arms 66*a* and 66*b*. As a result, the rubber touch feeling is eliminated from the key touch feeling when the button 22 is pressed. The key touch favorable to users is successfully created.

The reaction force of the head part 65 is easily adjusted by appropriately selecting the number of the arms 66*a* and 66*b*, or the mounting positions, length and thickness thereof. With this, the feeling (of click) caused at the time of pressing the button 22 is easily adjusted, and as a result, the portable computer 61 with improved operability is provided.

Figure 11:
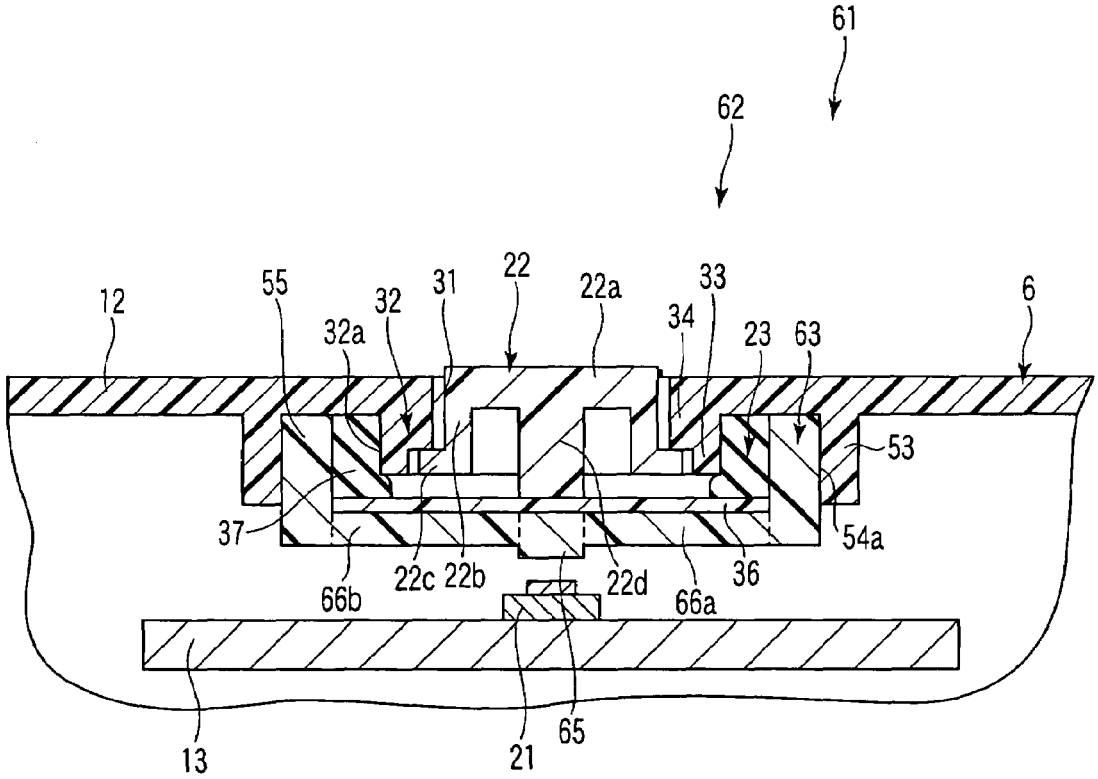
FIG. 11 is an exemplary cross-sectional view showing a modification of the push button unit according to the third embodiment.

For example, the raised part 37 of the sealing member 23 and the flat part 36 may be formed separately, as shown FIG. 11. In this case, the flat part 36 may be a flexible synthetic resin sheet. The sheet flat part 36 is bonded to the lower end of the raised part 37 by an adhesive member, for example.

The head part 65 and the arms 66*a* and 66*b* may be formed on a holder not supported by the second standing wall 53, like the holder 24 in the first embodiment. It is not essential that the sealing member 23 is made of an elastic material, but it suffices that the sealing member 23 is flexible as long as the holder 63 has the arms 66*a* and 66*b*.

Figure 12:
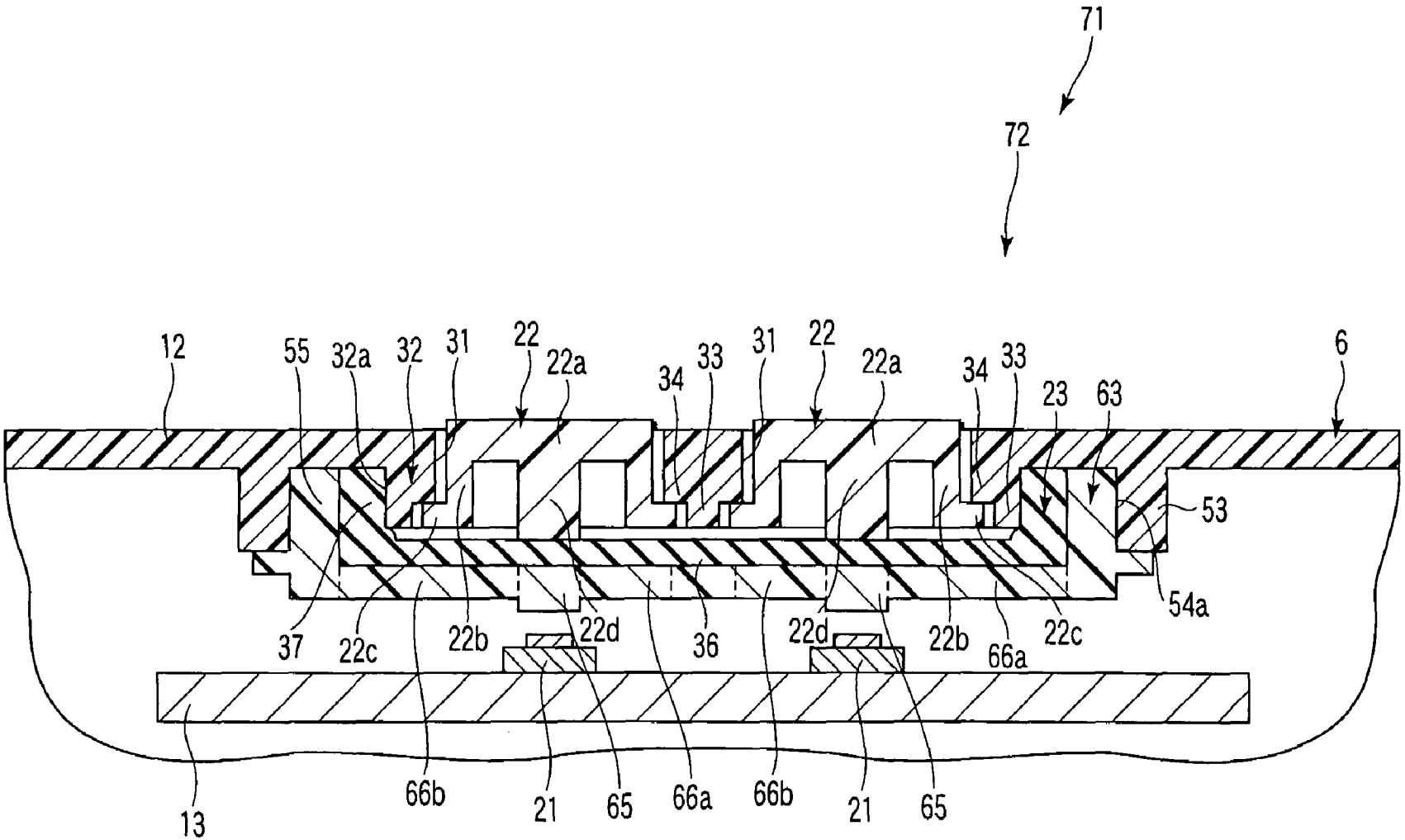
FIG. 12 is an exemplary cross-sectional view showing a push button unit according to a fourth embodiment of the invention.

A portable computer 71 as an electronic device according to a fourth embodiment of the invention will be described with reference to FIG. 12. Like reference numerals are used for designating like or equivalent portions in the portable computers 1 and 51, and 61 in the first to third embodiments, and descriptions thereof are omitted for simplicity of explanation. The portable computer 71 is provided with a push button unit 72.

A first standing wall 32 of the portable computer 71 surrounds two openings 31, arranged side by side. The sealing member 23 of the push button unit 72 entirely covers the lower side of the two openings 31. The holder 63 includes a plurality of head parts 65 opposed by a plurality of switches 21, and arms 66*a* and 66*b* connecting the head parts 65 to a frame body 55.

In the portable computer 71 thus constructed, the periphery of the openings 31 are easily sealed irrespective of the size and the configuration of the buttons 22. It is effective to apply the embodiment of the invention to the sealing structure having a plurality of buttons, since the periphery of the opening is easily and uniformly sealed without increasing the size and number of the fixing members, even if the number of the buttons 22 is large.

A portable computer 81 as an electronic device according to a fifth embodiment of the invention will be described with reference to FIG. 13. Like reference numerals are used for designating like or equivalent portions in the portable computers 1 and 51, and 61 in the first to third embodiments, and descriptions thereof are omitted for simplicity of explanation.

The portable computer 81 is provided with a push button unit 82. The push button unit 82 includes a switch 21, a button 22, a sealing member 83, and a holder 84.

A standing wall 32 of the portable computer 81 includes a bottom wall 85 extending from the extended end of the standing wall 32 toward the inner side of the opening 31. As shown in FIG. 13, the sealing member 83 is placed on the bottom wall 85, and located between the button 22 and the switch 21. A raised part 37 of the sealing member 83 is mounted along an inner peripheral surface 32*b* of the standing wall 32.

Figure 13:
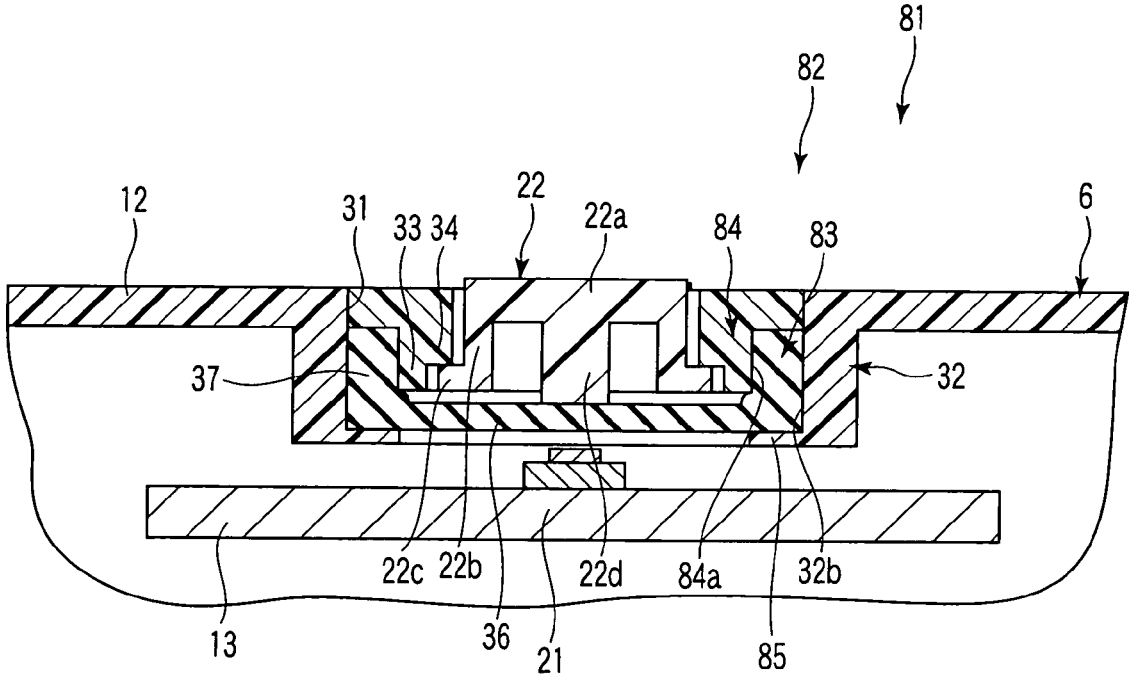
FIG. 13 is an exemplary cross-sectional view showing a push button unit according to a fifth embodiment of the invention.

As shown in FIG. 13, the holder 84 is mounted on the opening 31. The holder 84 is fitted to the standing wall 32 such that the raised part 37 of the sealing member 83 is put between the holder 84 and the standing wall 32. The holder 84 having been fitted to the standing wall 32 presses the raised part 37 of the sealing member 83 against the inner peripheral surface 32*b* of the standing wall 32. As a result, the raised part 37 of the sealing member 83 is held, while being compressed, between the outer peripheral surface 84*a* of the holder 84 and the inner peripheral surface 32*b* of the standing wall 32.

In the portable computer 81 thus constructed, the periphery of the opening 31 is easily sealed irrespective of the size and the configuration of the button 22. That is, the sealing member 83 of the current embodiment is held, while being compressed, between the standing wall 32 and the holder 84. As in the first embodiment, even in the electronic device having large buttons or buttons having complicated shapes, the periphery of the opening 31 is easily and uniformly sealed without increasing the size and the number of the fixing members.

Figure 14:
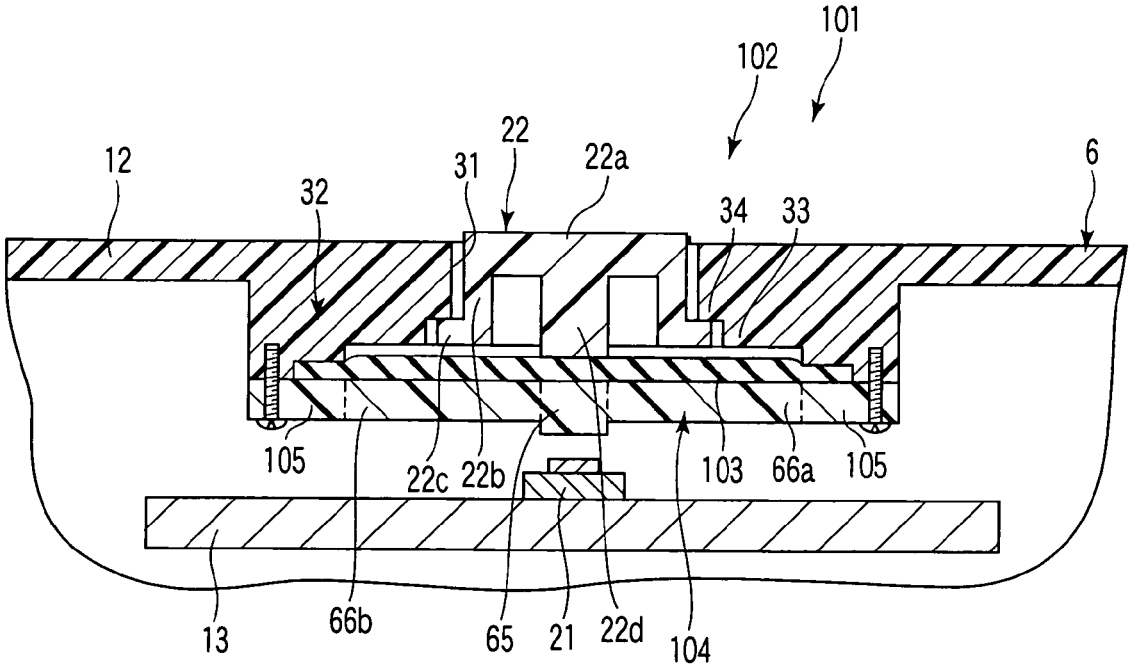
FIG. 14 is an exemplary cross-sectional view showing a push button unit according to another embodiment.

A portable computer 101 as an electronic device according to another embodiment will be described with reference to FIG. 14. Like reference numerals are used for designating like or equivalent portions in the portable computers 1 and 51, and 61 in the first to third embodiments, and descriptions thereof are omitted for simplicity of explanation.

The portable computer 101 is provided with a push button unit 102. The push button unit 102 includes a switch 21, a button 22, a sealing member 103, and a holder 104. The sealing member 103 is shaped like a plate. The holder 104 includes a mounting part 105, a head part 65, and arms 66*a* and 66*b*. The mounting part 105 of the holder 104 is fixed to the standing wall 32 by means of screws in a state that the edge part of the sealing member 103 is put between the mounting part 105 and the lower surface of the standing wall 32. The sealing member 103 is held, while being compressed, between the lower surface of the standing wall 32 and the upper surface of the holder 104. For example, the holder 104 may be fixed to the housing 6 by welding, in place of the screwing.

In the portable computer 101 thus constructed, the button 22 is elastically supported by the arms 66*a* and 66*b*. Accordingly, the rubber touch feeling is eliminated from the key touch feeling when the button 22 is pressed. The key touch favorable to users is successfully created.

The reaction force of the head part 65 is easily adjusted by appropriately selecting the number of the arms 66*a* and 66*b*, or the mounting positions, length and thickness thereof. With this, the feeling caused at the time of pressing the button 22 is easily adjusted, and as a result, the portable computer 101 with improved operability is provided.

While the portable computers 1, 51, 61, 71, and 81 of the first to fifth embodiments have been described, it should be understood that the present invention is not limited to those portable computers. For example, various components used in the embodiments of the invention may be appropriately combined if required. The present invention may be applied to various types of push buttons, such as buttons of a touch pad, and power buttons. Further, the present invention may be applied to various types of electronic devices, such as mobile phones, digital cameras, video cameras, and personal digital assistants, in addition to the portable computer.

While certain embodiments of the inventions have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. An electronic device comprising:

a housing including an opening;

a switch in the housing;

a button in the opening, the button facing the switch;

a first frame in the housing, the first frame surrounding the opening;

a sealing member disposed between the button and the switch and comprising an edge part;

a holder comprising a frame body surrounding the edge part of the sealing member; and a second frame surrounding the first frame, the edge part of the sealing member and the holder being located between the first frame and the second frame.

2. The electronic device according to claim 1, wherein the first frame and the second frame are provided on an inner surface of the housing.

3. An electronic device comprising:

a housing comprising an opening;

a switch in the housing;

a button in the opening, the button being configured to be moved toward the switch;

a wall extending in the housing from a surrounding portion of the opening;

a sealing member being between the button and the switch, covering the opening, and comprising an edge part facing the wall;

a holder facing a side surface of the edge part of the sealing member and pressing the edge part of the sealing member against the wall in a direction intersecting a direction in which the switch is movable; and a fixing portion on the housing, the fixing portion fixing the holder.

4. The electronic device according to claim 3, wherein the fixing portion is a projection.

5. The electronic device according to claim 4, wherein the projection is projected from an inner surface of the housing.

6. The electronic device according to claim 3, wherein the side surface is an outermost peripheral surface of the edge part of the sealing member.

7. The electronic device according to claim 3, wherein the side surface extends in the direction in which the switch is movable.

8. The electronic device according to claim 3, wherein the sealing member further comprises a flat part extending horizontally and covering the opening, and the entire edge part vertically extends from a peripheral edge of the flat part.

9. The electronic device according to claim 3, wherein the wall downwardly projects from an inner surface of the housing.

10. The electronic device according to claim 9, wherein the housing comprises an upper wall, the wall projects longer than a thickness of the upper wall, and the edge part of the sealing member faces an entire outer peripheral surface of the wall.

11. The electronic device according to claim 3, wherein the wall projects from an inner surface. of the housing and is formed cylindrical.

12. The electronic device according to claim 11, wherein the holder is cylindrical, has a size greater than the sealing member, and faces an outer surface of the edge part of the sealing member.

13. The electronic device according to claim 3, further comprising a second wall surrounding an outer periphery of the holder and holding the holder and the edge part of the sealing member together with the wall.

14. The electronic device according to claim 13, wherein the second wall projects from an inner surface of the housing.

* * * * *